United States Patent [19]

Wenzel

[11] Patent Number: 4,893,372

[45] Date of Patent: Jan. 16, 1990

[54] FREE-HAND TOWEL

[75] Inventor: Ronald E. Wenzel, Seattle, Wash.

[73] Assignee: Myron H. Berg, Seattle, Wash. ; a part interest

[21] Appl. No.: 246,120

[22] Filed: Sep. 16, 1988

[51] Int. Cl.[4] ..... A47L 13/18

[52] U.S. Cl. ..... 15/227; 2/16; 2/59; 2/158

[58] Field of Search ..... 15/227; 2/16, 59, 158; D6/608

[56] References Cited

U.S. PATENT DOCUMENTS

| | | | |
|---|---|---|---|
| 1,194,627 | 8/1916 | Hill | 2/59 |
| 2,326,422 | 8/1943 | Weisberger | 2/59 |
| 4,426,739 | 1/1984 | Wadsworth | 2/16 |

FOREIGN PATENT DOCUMENTS

| | | | |
|---|---|---|---|
| 915893 | 8/1946 | France | 15/227 |
| 396338 | 8/1933 | United Kingdom | 15/227 |

*Primary Examiner*—Edward L. Roberts

*Attorney, Agent, or Firm*—Robert W. Beach; Ward Brown

[57] ABSTRACT

A free-hand tubular towel has at its upper end an elastic band for encircling and gripping a user's arm at a location above or slightly below the elbow and has an enlarged lower end portion that drapes loosely over the user's hand and can be reverse-folded over the upper end portion to uncover the hand. The lower end portion can be secured in retracted position over the tubular upper end portion of the towel by interengagement of coacting patches of a hook-and-pile fastener, one being located near the upper end of the towel and the other being located near the lower end of the towel.

2 Claims, 1 Drawing Sheet

FREE-HAND TOWEL

BACKGROUND OF THE INVENTION

1. Field of the Invention

This invention relates to a free-hand towel to be worn over the forearm and hand of the user without constricting the hand which it covers and without the necessity of the hand clutching the towel to control its movement.

2. Prior Art

The most similar article of which applicant is aware is shown in U.S. Pat. No. 2,326,422, issued Aug. 10, 1943, for an Arm Protector or the Like. While this article is somewhat similar to the article of the present invention in appearance, it is not intended to be used for a purpose similar to the purpose for which the free-hand towel of this invention was designed and would not be effective for such purpose.

SUMMARY OF THE INVENTION

The principal object of the present invention is to provide a towel carried on the forearm and extending over the hand of the user, making it immediately available for use as a wiper and convenient for such use.

More specific objects are to provide a free-hand towel which is easy and quick for a user to put on over his forearm, which can be adjusted readily to fit the contour of the forearm, hand and fingers to suit the job at hand and to provide fresh surfaces for use, which can be left on the arm while the hand remains free to do other things than hold the towel, which can be removed easily from the forearm and which can be reconditioned for reuse by washing or dry cleaning.

It is also an object to provide a towel which can be made of various desired types of cotton, wool and synthetic material, including terry cloth, flannel and chamois skin.

The foregoing objects can be accomplished by a towel having an upper portion that can be fitted more or less snugly over the forearm and a lower portion that can dangle loosely over the hand. The towel can be held securely on the forearm by incorporating in its upper end constricted portion an elastic band that will grip the arm above or just below the elbow. The towel flares from such upper end constricted portion to the hand-covering lower end portion.

DETAILED DESCRIPTION

Figure 1:
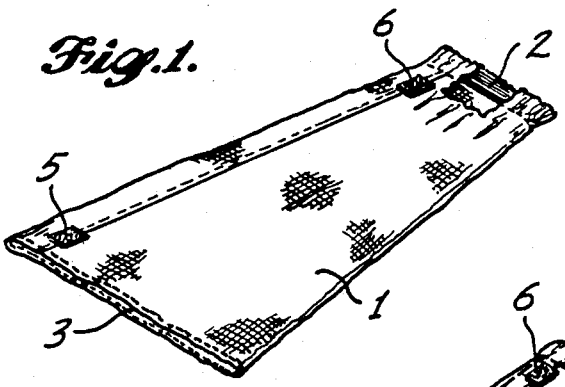
FIG. 1 is a top perspective of the free-hand towel when not being worn.

Towels are used for many purposes. A mechanic uses a wiping cloth or towel to wipe off greasy parts and greasy hands. Cooks in restaurants use wiping cloths to wipe off cooking ranges and other cooking accessories and utensils. Restaurant waiters use wiping cloths for wiping tables, chairs and even floors. Housekeepers use wiping gloves or wiping cloths for dusting and use wiping towels for drying dishes. Automobile washing establishments use wipers for cleaning parts of automobiles. Auto body shops, service stations and automobile owners use wipers for washing, waxing and polishing automobiles. Wipers are used for polishing furniture and for cleaning windows.

Towels or wipers for different purposes have been of different sizes, shapes and materials. Customarily wipers have been made of terry cloth or flannel, but for wiping glass surfaces such as automobile windshields and windows, wipers have been made of chamois skin. The towel of the present invention is adapted for the various uses stated above and for any other cleaning use for which towels or wipers have been used. It can be made of different materials or even be a composite of different materials in a single wiper.

The wiper of the present invention is a free-hand towel including a tubular body 1 having an upper constricted end portion with an integral elastic band 2 encircling such end. The towel flares from its upper constricted end portion to its enlarged lower end wiping portion adjacent to its lower end 3 which drapes over the hand as shown in FIG. 2.

The towel is of a length to extend over the forearm and hand of a person from a location above or slightly below the elbow to a location beyond the fingertips of the user. The elastic band 2 is of a size to grip the average arm above or slightly below the elbow firmly but not uncomfortably tightly. Of course, the towel can be supplied in different diameters and lengths to fit over forearms and hands of different size more comfortably.

It is important that the towel be of a length which will cover the hand so that the exterior side of the lower portion of the towel can be used for wiping purposes with the interior side of the lower portion backed by the palm of the hand and the fingers which may be spread to some extent. The double thickness upper constricted end portion of the towel tube in flattened condition has a width of 4 inches to 6 inches (10.16 cm to 15.24 cm) and the double thickness lower end portion of the towel tube should be of a flat width of 10 inches to 15 inches (25.4 cm to 38.1 cm). The overall length of the towel body is preferably within the range of 15 inches to 18 inches (38.1 cm to 45.72 cm).

Figure 2:
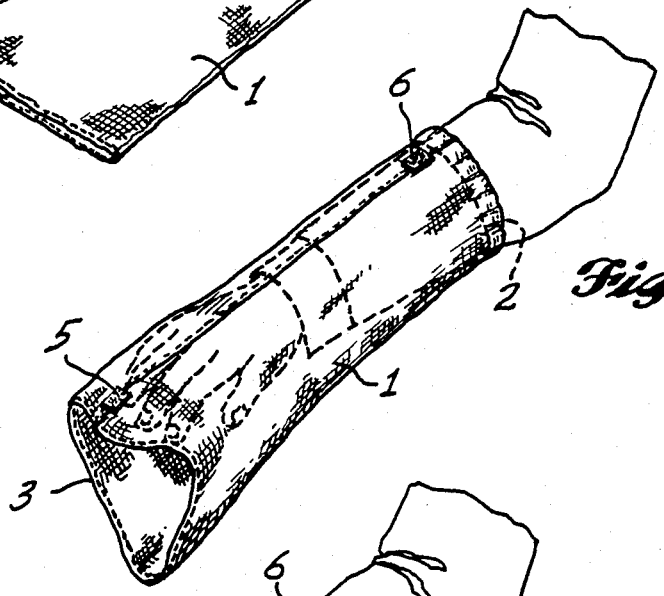
FIG. 2 is a top perspective of the towel being worn by a user when not in wiping use.
Figure 3:
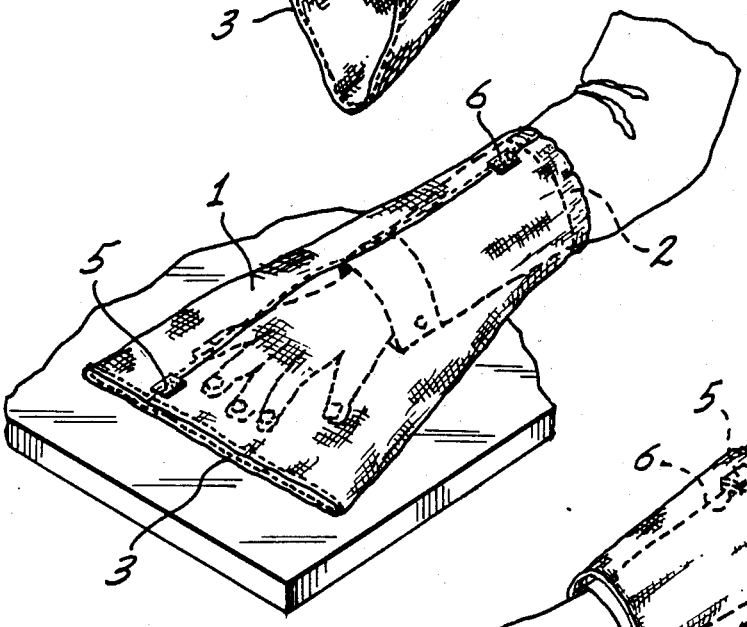
FIG. 3 is a top perspective of the towel shown in wiping use.
Figure 4:
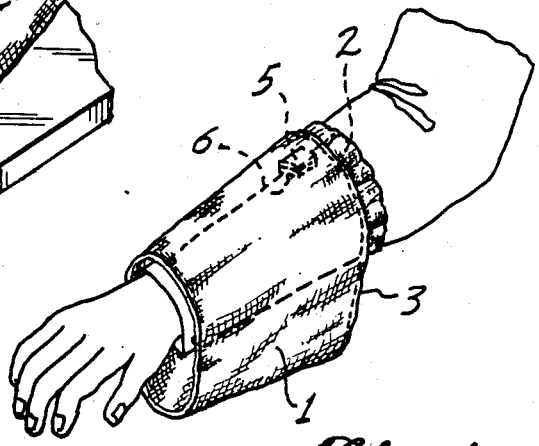
FIG. 4 is a top perspective of the towel with its lower end portion retracted by being reversely folded over the upper end portion of the towel.

In normal use, the lower end portion of the towel dangling over the hand as shown in FIG. 2 is always ready for instantaneous wiping use, as shown in FIG. 3. The hand is always free and unconfined. The towel is always supported by the arm and need not be held or clutched by the hand. If a particular part of the lower end portion of the towel becomes soiled, the elastic band 2 can be shifted circumferentially of the arm or shifted up or down along the arm to expose a clean area of the lower end portion of the towel to be backed by the palm of the user's hand. Because the towel is in the form of a tube carried by the user's forearm, it is always available for immediate use, whereas a loose wiper can be laid down at one location so that it is not available for use at a different location, instead of the wiper being kept with the user.

Because of the elastic band 2, the towel tube can be quickly and easily applied to the forearm and just as easily and quickly pulled off the forearm. If use of the hand is required outside the towel, it can be poked out of the lower open end 3 of the towel tube and, if it is desired to use the hand outside the towel for an extended period, the lower end portion of the towel can be folded reversely over the upper end portion of the towel tube from the position shown in FIG. 2 to the position shown in FIG. 3. Because the towel tube body flares downward between its upper end and its lower end, it is desirable to provide coacting Velcro or hook-and-pile fastener patches 4 adjacent to the lower end of the towel and 5 adjacent to the upper end of the towel tube. Consequently, when the lower end portion of the towel is reverse-folded over the upper end portion of the towel tube, attachment of the two fastener components will hold the lower end 3 of the towel securely at a location adjacent to the elbow. Preferably, such mating fastener patches are provided on opposite sides of the towel tube.

I claim:

1. A free-hand tubular towel comprising a tubular body flaring from an upper constricted end portion toward a lower enlarged wiping end portion, an elastic band carried by the upper end portion of said tubular body for encircling and gripping the arm of a wearer above or slightly below the elbow with the lower enlarged wiping end portion of said tubular body dangling loosely over the hand, one component of a hook-and-pile fastener being carried by the upper end portion of said tubular body and a second component of a hook-and-pile fastener being carried by the lower end portion of said tubular body at locations adapted for fastening engagement of the two fastener components when the lower end portion of said tubular body is reverse-folded over the upper end portion of said tubular body.

2. A free-hand towel comprising a body, means for securing a tubular upper end portion of said body encircling the arm of a user, said body having a lower end portion adapted to be draped over the hand of the user, a first component of a hook-and-pile fastener carried by the upper end portion of said body, and a second component of the fastener carried by the lower end portion of said body in a position for engagement with said first fastener component to hold the lower end portion of said body in reverse-folded position overlying the upper end portion of said body with the hand of the user uncovered.

* * * * *